US006015054A

United States Patent [19]

King et al.

[11] Patent Number: 6,015,054

[45] Date of Patent: Jan. 18, 2000

[54] CONTAINER CLOSURE ASSEMBLY WITH PROFILED SCREW THREADS

[75] Inventors: Roger Milner King; Witney Milner King, both of Latimer, United Kingdom

[73] Assignee: Beeson and Sons Limited, England, United Kingdom

[21] Appl. No.: 09/077,716

[22] PCT Filed: Dec. 9, 1996

[86] PCT No.: PCT/GB96/03028

§ 371 Date: Dec. 24, 1998

§ 102(e) Date: Dec. 24, 1998

[87] PCT Pub. No.: WO97/21602

PCT Pub. Date: Jun. 19, 1997

[30] Foreign Application Priority Data

Dec. 8, 1995 [GB] United Kingdom ..... 9525146
Dec. 18, 1995 [GB] United Kingdom ..... 9525876

[51] Int. Cl.[7] ..... B65D 41/36

[52] U.S. Cl. ..... 215/252; 215/44; 215/307; 215/330; 220/296

[58] Field of Search ..... 215/44, 217, 218, 215/220, 222, 252, 329, 330, 331, 307; 220/290, 293, 296, 298, 366.1, 374

[56] References Cited

U.S. PATENT DOCUMENTS

| | | |
|---|---|---|
| D. 327,644 | 7/1992 | Offley et al. . |
| D. 329,980 | 10/1992 | Powell et al. . |
| D. 364,808 | 12/1995 | King . |
| D. 381,907 | 8/1997 | King . |
| D. 392,187 | 3/1998 | King . |
| 2,600,703 | 6/1952 | Strom . |
| 2,623,657 | 12/1952 | De Vries . |
| 4,084,717 | 4/1978 | King . |
| 4,275,817 | 6/1981 | Patton . |
| 4,387,817 | 6/1983 | Wiles et al. . |
| 4,392,055 | 7/1983 | Whitney . |
| 4,444,327 | 4/1984 | Hedgewick . |
| 4,456,137 | 6/1984 | Lyman . |

(List continued on next page.)

FOREIGN PATENT DOCUMENTS

| | | |
|---|---|---|
| 0 227 203 | 7/1987 | European Pat. Off. . |
| 261370 | 4/1927 | United Kingdom . |
| 2 257 693 | 1/1993 | United Kingdom . |
| 2 260 534 | 4/1993 | United Kingdom . |
| 2 261 656 | 5/1993 | United Kingdom . |
| 2 262 280 | 6/1993 | United Kingdom . |
| 2 264 108 | 8/1993 | United Kingdom . |
| 2 267 076 | 11/1993 | United Kingdom . |
| 2 267 082 | 11/1993 | United Kingdom . |
| 2 267 484 | 12/1993 | United Kingdom . |
| 2 275 048 | 8/1994 | United Kingdom . |
| 2 288 390 | 10/1995 | United Kingdom . |
| WO 91/07331 | 5/1991 | WIPO . |
| WO 91/18799 | 12/1991 | WIPO . |
| WO 93/01098 | 1/1993 | WIPO . |
| WO 94/11267 | 5/1994 | WIPO . |
| WO 95/05322 | 2/1995 | WIPO . |

OTHER PUBLICATIONS

Pending Beeson & Sons Patent Application No.: 08/837,434, Inventor: King, Filing Date: Apr. 17, 1997.

*Primary Examiner*—Stephen K. Cronin
*Attorney, Agent, or Firm*—Brinks Hofer Gilson & Lione

[57] ABSTRACT

The invention provides container closure assemblies, especially for carbonated beverage containers, having substantially helical second thread segment (20) with a profiled lower thread surface (24). The profiled lower thread surface (24) includes a first, lower region (28) with a low pitch and a second region (30) with a steep pitch. The thread (20) may also include a step feature (32) to block unscrewing of the closure at an intermediate position where gas venting can take place, and a third region (34) of the said lower surface having a low pitch adjacent to the step. The closures are easy to apply and remove, and do not blow off unpredictably or uncontrollably under pressure.

22 Claims, 4 Drawing Sheets

U.S. PATENT DOCUMENTS 4,553,678 11/1985 Thorsbakken .
4,669,624 6/1987 Wiles et al. .
4,799,597 1/1989 Mayes et al. .
4,936,474 6/1990 Szczesniak et al. .
5,135,124 8/1992 Wobser .
5,213,225 5/1993 King et al. .
5,219,084 6/1993 King .
5,320,233 6/1994 Welch .
5,411,157 5/1995 King et al. .
5,443,175 8/1995 Kelly et al. ..... 220/298
5,454,476 10/1995 King et al. .
5,533,633 7/1996 King .
5,588,545 12/1996 King .
5,590,799 1/1997 King .
5,611,443 3/1997 King .
5,638,969 6/1997 King .
5,667,088 9/1997 King et al. .
5,676,268 10/1997 King .
5,743,419 4/1998 King .
5,769,254 6/1998 King et al. .
5,788,101 8/1998 King .
5,794,806 8/1998 Harris et al. ..... 220/290 X
5,819,965 10/1998 King et al. .
5,836,465 11/1998 King .

CONTAINER CLOSURE ASSEMBLY WITH PROFILED SCREW THREADS

The present invention relates to a container neck and closure assembly in which the neck and closure are provided with screw threads for securing the closure on the container neck.

A number of container closure assemblies comprising a container neck and a closure, with threads on the neck and closure for securing the closure on the neck are known in the art. The threads known in the art can be divided broadly into two categories, namely continuous (helical) threads and bayonet threads. Continuous threads comprise at lest one substantially continuous thread portion on either the neck or the closure, the thread portion or portions extending substantially helically around the outside of the container neck or the inside of the closure skirt. At least part of each thread portion usually overlaps (i.e. is axially displaced from, at the same radial position as) at least another part of the thread portion, or part of another thread portion. The spacing between the upper and lower surfaces of the helical thread defines a substantially helical thread path along which a second thread segment on the container closure skirt or the container neck travels when securing or removing the closure from the container neck.

In contrast, bayonet threads have short thread segments spaced around the container neck and the closure skirt. The closure is secured on the container neck by first pushing down the closure with the thread segments on the closure neck and closure skirt out of register, followed by rotating the closure to engage the thread segments on the closure skirt beneath the thread segments on the container neck. The bayonet thread segments usually have little or no pitch.

Bayonet-type threads have the following advantages when compared with continuous threads: (1) a smaller amount of moulding material is required to form the short thread segments of the bayonet thread; (2) less rotation is normally required to secure the closure cap on the container neck, which is advantageous for elderly or arthritic users; (3) the bayonet thread segments themselves are not pitched, or have a very low pitch angle. This means that the closure has less tendency to unscrew spontaneously due to camming of axial force on the closure by pressure from inside the container. This means that the closure is less likely to blow off when the contents of the container are pressurized.

The bayonet-type threads have the following drawbacks when compared with continuous, helical threads: (1) the bayonet threads can make it more difficult to secure the closure on the container neck, because two operations are required to secure the closure on the container neck, namely pressing down on the closure with the threads out of engagement, followed by rotating the closure. In contrast, continuous threads allow the closure to be secured on a container neck in a single, continuous rotation. (2) bayonet-type threads can make it difficult to achieve a pressure-tight seal between the closure and the container neck. Such seals depend on the exertion of a strong axial sealing force between sealing surfaces on the closure and the neck. In a continuous thread arrangement, this force is exerted by camming of the closure torque applied to the closure through the thread pitch. In the case of the bayonet threads, the axial sealing force must be substantially applied by the user in the initial pressing-down step of securing the closure on the container neck; (3) bayonet-type threads are inherently less suitable for use in conjunction with a tamper-evident ring frangibly attached to the closure skirt and retained on the container neck. Reliable separation of a tamper-evident ring from the closure is best achieved with continuous, helical threads since the pitch of the threads converts the unscrewing torque into a lifting force that separates the closure from the tamper-evident ring. In contrast, the bayonet-type thread requires all of the lifting force needed to separate the tamper-evident ring from the closure skirt to be exerted by the user, which may be particularly difficult for elderly or arthritic users.

It can thus be seen that neither bayonet-type threads nor continuous, helical pitched threads offers an ideal solution to the problem of devising a container closure assembly. This is especially the case where the container closure assembly is intended for a container for pressurized fluids, such as a carbonated beverage container. In such cases, it would be desirably to combine complete security against blowing off of the closure under pressure with ease of opening and resecuring, efficient gas-tight sealing, and reliable separation of a tamper-evident ring from the closure when the assembly is opened for the first time.

Existing, commercially mass-produced carbonated beverage containers use threads on the container and closure of the continuous, helical type. The threads comprise a single, substantially continuous thread portion on the container neck with a low pitch angle, typically 5° or less. The low pitch angle is needed in order to ensure that the closure does not unscrew spontaneously under pressure from inside the container. The low pitch angle also provides the necessary leverage to achieve a gas-tight compressive seal between the closure and the container neck when the closure is tightened onto the container neck. The low pitch of the helical threads also means that the closure typically needs to be rotated through more than 360° to disengage it completely from the container neck. Whilst this is more laborious, especially for elderly or arthritic users, it also permits some gas venting to take place while the closure is being unscrewed, and thereby reduces the risk that the closure will blow off uncontrollably once unscrewing of the closure from the container neck has commenced. This gas venting is usually assisted by the provision of axial gas venting notches extending axially through the helical threads. Drawbacks of these helical threads include the laborious rotation required to remove and resecure the closure on the neck, excessive use of material to form the long helical threads and unreliable separation of a tamper-evident ring from the closure skirt due to the low pitch angel of the threads.

Our earlier International Patent Application WO95/05322 describes improved continuous helical threads for container closure assemblies especially adapted for pressurized containers such as carbonated beverage containers. The threads on the neck or the closure are provided with mutually engagable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly. The container closure assemblies described in WO95/05322 also preferably include complementary locking elements on the closure and the container neck to retain the closure in the fully engaged position on the container neck until a predetermined minimum opening torque is applied. These locking elements also reduce the tendency of the closure to unscrew itself spontaneously when placed under axial pressure from inside the container neck. They thus help to remove another disadvantage of continuous helical threads, especially more steeply-pitched and/or short and/or multi-start and/or free-running helical threads in assemblies of this type.

GB-A-2288390 describes a container and closure assembly for a carbonated beverage container. A closure cap screws onto a container neck in less than half a turn, with pins on the cap engaging between screw thread segments on the container neck. The threads are variably pitched to give a decreased final angle of pitch at the closed, sealing position of the cap on the neck, thereby reducing the tendency of the cap to blow off when the container is pressurized. However, the retaining pins on the closure cap are difficult to form by injection moulding. Moreover, the pins are inherently unsuitable for retaining a cap on a pressurized container, because they cause the axial force exerted by the pressure inside the container to be concentrated on a small region of the thread segments on the container neck, thereby causing the thread segments to deform and allowing the pins to ride over the thread segments so that the cap blows off the container.

It has also been proposed to use bayonet-type threads in container closure assemblies for pressurized containers. For example, U.S. Pat. No. 5,135,124 describes a bayonet-type thread arrangement for a container closure assembly for a carbonated beverage container. The closure is provided with a complex double-bayonet thread arrangement to provide for gas venting at an intermediate position of the closure on the container neck. However, it should be noted that this container closure arrangement suffers from all the disadvantages of bayonet thread arrangements enumerated above, and in addition provides a less reliable pressure safety feature than the arrangement of WO95/05322.

Accordingly, it is an object of the present invention to provide improved container closure assemblies that substantially overcome the above-enumerated drawbacks of both continuous helical threads and bayonet-type threads on existing container closure assemblies.

It is a further object of the present invention to provide such an improved container closure assembly for a pressurized container, in particular for a carbonated beverage container.

The present invention provides a container closure assembly comprising:

a container neck having an opening;

a closure for said neck, the closure having a crown portion and a skirt portion;

a first screw thread on one of said neck and said closure, said first screw thread comprising one or more elongate first thread segments, each first thread segment having upper and lower first thread surfaces; and a substantially continuous second screw thread on the other of said neck and said closure, said second screw thread comprising one ore more elongate second thread segments, each second thread segment having upper and lower second thread surfaces, wherein the pitch of the lower second thread surface is relatively lower in a first region, relatively higher in a second region displaced from the first region in an unscrewing direction, and relatively lower in the a third region displaced from said second region in an unscrewing direction, and wherein said lower second thread surface further comprises a step adjacent to said third region to provide a first abutment surface against which a second abutment surface on one of the first screw segments abuts to block or restrict rotation of said closure in an unscrewing direction at an intermediate position when said closure is under axial pressure in a direction emerging from the container neck, said neck and closure being constructed and arranged to provide a vent for venting gas from said container neck at least when said closure is in said intermediate position, and said neck and closure being constructed and arranged to enable such step and said first screw segments to be moved out of engagement by axial displacement of the closure inwardly on said neck at said intermediate position, and wherein the said lower second thread surface in said first region forms a matching fit with a major part of said first region of said upper first thread surface when the closure is fully secured on the container neck, and said third region forms a matching fit with a major part of upper first thread surface when the closure is at said intermediate position and outwardly displaced in said container neck.

In the foregoing the word "lower thread surface" refers to the thread surface located either furthest from the opening of the container neck when the thread is on the container neck, or closest to the base of the closure when the thread is on the closure skirt.

Preferably, the first region is a region of the lower second thread surface that is at or near the lower end of the lower second thread surface.

The second thread segments are substantially continuous. That is to say, the second thread segments are not bayonet thread segments, but rather define between overlapping or near-overlapping portions thereof a continuous, helical or near-helical thread path along which the first thread segments travel substantially continuously when securing the closure on the container neck in the absence of axial pressure from inside the container. In other words, the second thread segments are substantially helical threads, but provided with profiled upper and lower surfaces in accordance with the invention. The second thread segments may be provided with axial gas venting passages, as is conventionally known in the art.

In use, the first thread segment abuts against the first region of the lower surface of the second thread segment when the closure is fully engaged on the container neck. The relatively low pitch of the first region means that the rotational unscrewing force exerted as a result of pressure from inside the container neck is relatively low, in accordance with well-known mechanical principles. This means that the closure has less tendency to unscrew spontaneously under pressure than would be the case if conventional, parallel-sided helical threads of the same average pitch had been used. A further advantage is that a small closing torque in the region of full engagement of the closure on the container neck is converted into a large axial downward force of the closure onto the container neck, resulting in efficient sealing between the closure and the container neck. It can thus be seen that the main advantages of a bayonet-type thread are achieved, whilst retaining all of the advantages of a continuous helix screw threads.

The first and second thread segments when the closure is in the fully closed and sealing position make a matching fit over a major pat of the upper surface of the elongate first thread segments. This helps to distribute the force exerted by the pressure inside the container more evenly around the container neck, thereby reducing the likelihood that the first and second threads will deform and/or allow the closure to blow off. The elongate thread segments can thus be made less high (i.e. projecting radially inwardly or outwardly a shorter distance) than the simple pins of GB-A-2288390. This in turn makes the container neck and closure easier to mould and reduces the amount of moulding material required.

The pitch of the lower second thread surface in the first region is relatively low. That is to say, the pitch is lower than the average (mean) pitch of the lower second thread surface. Preferably, the pitch of the lower second thread surface in the said first region is substantially constant. Preferably, this pitch lies in the range of −5° to 10°, more preferably 1° to 7°, and still more preferably 2° to 6°. preferably, the said first region extends for an angular distance of 10–40° about the circumference of the container neck or of the closure skirt.

The pitch of the lower second thread surface in the second region is relatively high. That is to say, the pitch is higher than the average (mean) pitch of the lower second thread surface. Preferably, the second region of the lower surface of the second thread is adjacent to the first region. Preferably, the pitch of the lower thread surface in the second region is in the range 12° to 20°. Preferably, the second region has substantially constant pitch and extends for 10–45° around the circumference of the container neck or of the closure skirt.

Preferably, the average (mean) pitch of the upper and lower second thread surfaces is in the range of 8° to 18°, more preferably 10–15°. Such steep, fast-pitched threads provide for easy securing and removal of the closure on the container neck. Preferably, the closure can be moved from a fully disengaged to a fully secured position on the container neck by single smooth rotation through 360° or less, more preferably 180° or less, and most preferably about 90° or less.

Preferably, the container closure assembly according to the present invention is adapted for use on a container for pressurized fluids, especially carbonated beverage. Preferably, the assembly according to the present invention further comprises means to provide a seal, preferably a pressure-tight seal, between the container neck and the closure when the closure is fully engaged on the container neck. Preferably, the means to provide a seal comprises a compressible sealing wad inside the base portion of the closure for abutting against a lip of the container neck. Preferably, the compressible sealing wad is formed from an elastomeric material bonded to the base of the closure. A circumferential sealing rib is preferably provided around the lip of the container neck to abut against the compressible sealing wad. Preferably, the circumferential sealing rib is both upwardly and outwardly directed.

As noted above, the relatively low pitch of the lower surface of the second thread near the bottom of the thread results in a reduced spontaneous opening torque on the closure when the closure is placed under axial pressure from inside the container neck. Nevertheless, if the pitch angle of the said lower region is greater than 0°, then some opening torque will result from such axial pressure. Accordingly, the container closure assembly according to the present invention preferably also comprises complementary locking means on the container neck and the closure to prevent unscrewing of the closure from the fully engaged position on the container neck unless a predetermined minimum opening torque is applied. A further advantage of providing these locking means is that the predetermined minimum opening torque can be controlled and optimised for each application. Yet another advantage is that the threads on the container neck and closure can be made free-running, whereby only minimal torque is required to screw the closure onto the container neck until the full engagement position is neared. This makes the closure easier for elderly, arthritic or very young users to apply. Yet another advantage of providing such locking means is that full engagement of the closure on the container neck is reached at a defined angular position of the closure on the neck, and is typically accompanied by a click that can be heard or felt by the user. This reduces the risk that the closure will be under-secured on the container neck.

Preferably, the locking means comprise a longitudinal locking rib on one of the container neck and the skirt portion of the closure, and a complementary locking ramp on the other of the container neck or the skirt portion of the closure, the locking rib abutting against a retaining edge of the locking ramp when the closure is fully engaged on the container neck.

The container closure assembly according to the present invention preferably further comprises a tamper-evident ring, preferably attached to the skirt portion of the closure. Preferably, the tamper-evident ring is integrally formed with the skirt portion of the closure, and joined thereto by frangible bridges. Preferably, the tamper-evident ring in the assemblies according to the present invention has flexible retaining tabs that are retained beneath a circumferential lip on the container neck. More preferably, ratchet projections are provided on the container neck to block rotation of the tamper-evident ring in a unscrewing direction. Most preferably, the tamper-evident ring, ratchet projections and retaining lip are as described and claimed in our International Patent Application WO94/11267, the entire content of which is hereby expressly incorporated by reference.

It is occasionally desirable to provide a two-component container closure assembly, in which two components are stored and distributed separately in a single assembly, the two components being mixed only when the assembly is opened immediately before use. This may be the case, for example, where one of the components undergoes slow decomposition when combined with the other component. This may also be the case when a varying concentration of the second component in the first component is desired by the user, for example where the second component is a flavouring concentrate and the first component is a diluent such as carbonated water.

Accordingly, the closure in the container closure assembly according to the present invention preferably further comprises: a storage cell having a mouth located in the crown portion of the cap and a continuous, sealed body portion formed in one piece integrally with the crown portion of the cap and extending downwardly from the crown portion inside the skirt portion of the cap for insertion inside the neck of the container in use; and a removable sealing means to seal the mouth of the storage cell.

The body of the storage cell is continuous and sealed. That is to say, the body does not have any aperture that can be opened to the interior of the container neck. The storage cell presents a continuous, liquid-impervious surface to the interior of the container neck. This ensures that it is completely impossible for liquid or gas from inside the container neck to seep into the storage cell during storage, unless the storage cell is actually cracked or broken.

The body of the storage cell may be formed in substantially any shape, provided that it can be formed in one piece and fits through the opening at the mouth of the container neck in use. However, for simplicity and ease of moulding, the storage cell is preferably substantially cylindrical, and preferably is rounded at the bottom.

Likewise, the mouth of the storage cell may be of substantially any configuration, but is preferably a substantially circular aperture in the crown portion of the closure. Preferably, the storage cell is substantially an open-ended cylinder having its open end at the crown of the closure, opposite to a rounded closed end.

The removable sealing means over the mouth of the storage cell may be any kind of cap or plug, but is preferably a peel-off sealing web, more preferably a foil web or a laminated foil web. The sealing web is preferably heat-bonded directly to the crown of the closure around the mouth of the storage cell.

As previously noted, the container closure assemblies according to the present invention are specifically adapted for pressurized containers, especially carbonated beverage containers. Accordingly, the container closure assemblies according to the present invention preferably comprise means for venting fluid, especially gas, from inside the container when the closure it at one or more intermediate positions between the fully engaged position on the container neck and the fully disengaged position. This gas venting is desirable in order to avoid the closure blowing off uncontrollably once unscrewing has begun. The gas venting means may include axial venting passages extending transversely across the first and/or second thread segments, as is conventionally known in the art for continuous helical threads on carbonated beverage closures. Alternatively or additionally, such gas venting can be achieved by providing a first thread that has a smaller cross-sectional area than at least part of the thread path defined between the second thread segments, whereby gas venting can take place along the said thread path, past the first thread segment.

The assemblies according the present invention include special safety features to prevent the cap blowing off uncontrollably. Preferably, these features include mutually engagement elements on the neck and closure to block or restrict rotation of the closure in an unscrewing direction beyond an intermediate position when the closure is under an axial pressure in a direction emerging from the container neck, the neck and closure being constructed and arranged to provide a vent for venting fluid from the container neck at least when the container is in the intermediate position.

The venting may take place through transverse axial vents as described above, or along a helical thread path as described above.

The first and second screw threads are constructed and arranged to permit axial displacement of the closure relative to the neck at least when the closure is at the said intermediate position, and the mutually engagable elements are adapted to engage each other when the closure is axially displaced in a direction emerging from the container neck. The axial mobility of the closure on the neck is typically achieved by providing first thread segments that are narrower than the thread paths provided between the second thread segments at the intermediate position.

The mutually engagable elements are constructed and arranged so that they do not mutually engage each other when the closure is axially displaced in a direction inwardly towards the neck at the said intermediate position. This would be the case for example, when the closure is being screwed down onto the container neck with the user pressing down on the closure.

The mutually engagable elements comprise a step or recess formed in the lower surface of one of the second screw thread segments so as to provide a first abutment surface against which a second abutment surface on one of the first screw thread segments abuts to block or restrict rotation of the closure in an unscrewing direction at the said intermediate position when the closure is under axial pressure in a direction emerging from the container neck. The first abutment surface may abut against an end of the first screw thread segment. Preferably, a complementary step or recess for mutual abutment with the first abutment surface is provided on the first thread segment.

Preferably, the step in the lower surface of the second screw thread segment is provided as follows. The second thread segment comprises a first thread portion having a first cross section and a second thread portion having a second cross section narrower than the first cross section, whereby a step is provided in the lower thread surface of the second thread segment where the first and second thread portions meet.

Preferably, the upper surface of the second thread segment opposite the said lower surface of the second segment is substantially smooth and continuous at the angular position where the first and second thread portions meet. The results in smooth screwing down of the closure onto the container neck in the absence of net axial force due to pressure from inside the container.

It can be seen that the above feature of a step or recess in the lower surface of the second thread segment provides a pressure-safety feature for the assembly by blocking unscrewing of the closure from the container neck until there is no net force emerging axially from the container neck due to pressure inside the container. The effectiveness of this pressure safety feature is enhanced by further profiling of the lower surface of the second thread segment, such that the pitch of the lower thread surface is relatively low in a third region adjacent to the step or recess in the lower thread surface in a screwing-down direction. The first thread segment abuts against this third region of the lower thread surface while it is also abutting against the step or recess at the intermediate gas venting position. The relatively low pitch of the lower thread surface means that relatively little of the axial force on the closure resulting from the pressure inside the container is cammed into a rotational unscrewing force, and accordingly there is less tendency for the closure to override the pressure safety feature under extreme pressures from inside the container.

Preferably, the configuration, size and pitch of the third region are as defined above for the preferred configuration, size and pitch of the first region.

It will be appreciated that a particular advantage of the assemblies according to the present invention is that they allow container closure assemblies to be made with continuous, helical threads, which may be steeply pitched and/or free-running threads. Preferably, at least one of the first and second threads has at least two thread starts, more preferably four thread starts. This makes resecuring of the closure on the container neck especially quick and easy. The various features of the assemblies according to the present invention enumerated above result in effective sealing of pressurized containers by the assemblies according to the invention, with little or no tendency for the closure to blow off spontaneously at high internal pressures in the container.

The use of more steeply pitched threads also ensures faster and more reliable separation of a tamper-evident ring from the closure skirt, since the steeply pitched threads cam the rotational motion of the closure into a lifting force that breaks the tamper-evident ring from the closure skirt.

Specific embodiments of the container closure assemblies according to the present invention will now be described further, by way of example, with reference to the accompanying drawings, in which.

Figure 2:
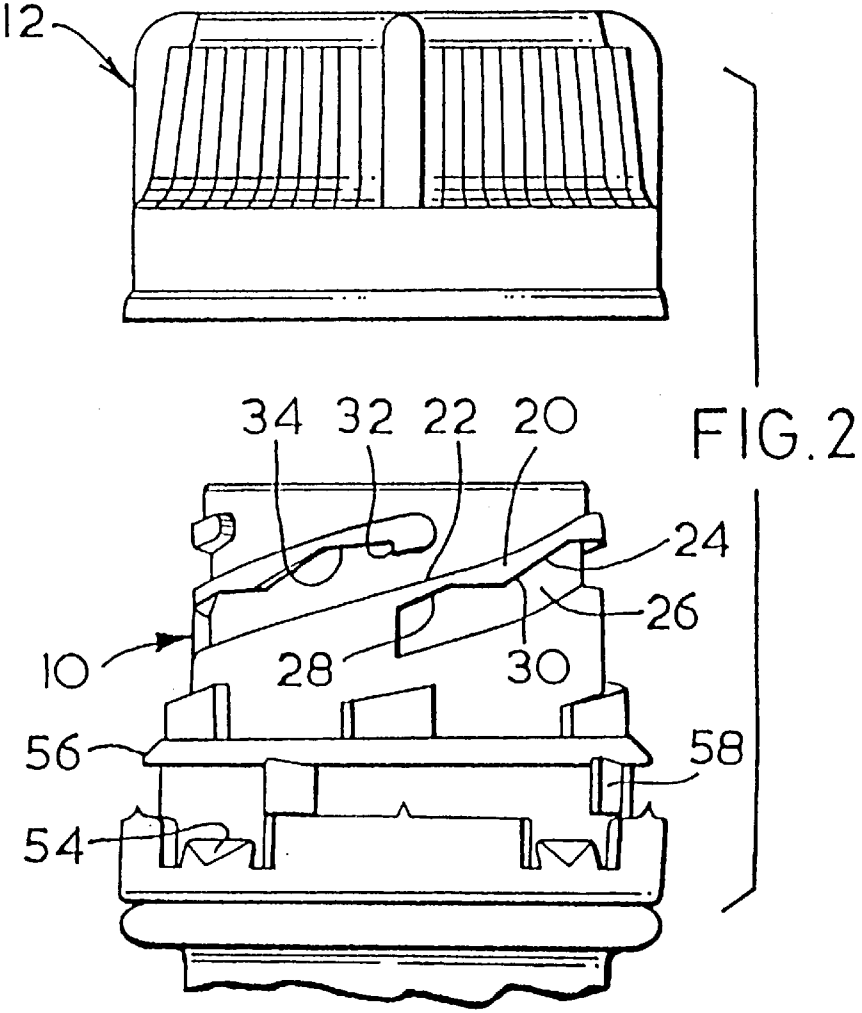
FIG. 2 shows a side elevation view of the container closure assembly of FIG. 1 after removal of the closure.
Figure 1:
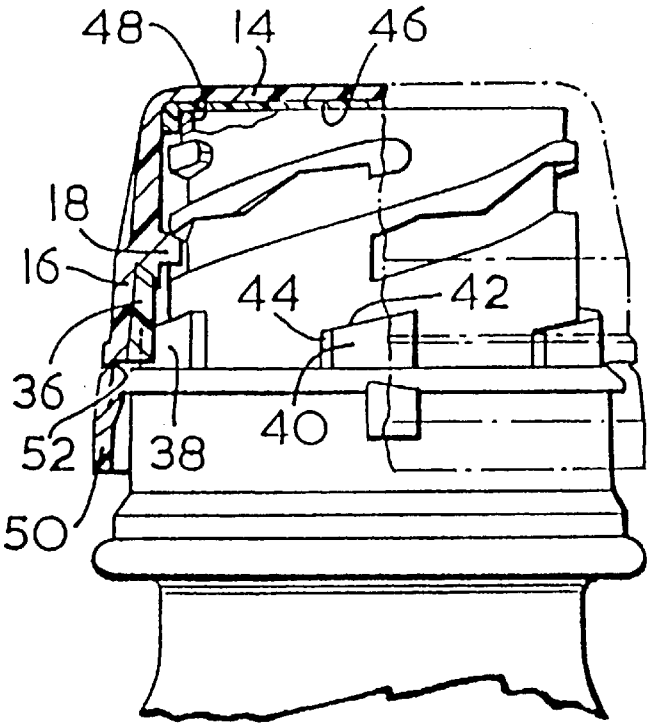
FIG. 1 shows a side elevation view of a container closure assembly according to the present invention with the closure in the fully engaged position on the container neck. The closure is shown partly cut away and partly cross section.

Referring to FIGS. 1 and 2, this embodiment is a container closure assembly especially adapted for a carbonated beverage container. The main features of this assembly resemble those of the assembly described and claimed in our International Patent Application WO95/05322, the entire content of which is expressly incorporated herein by reference.

The assembly includes a container neck 10 of a container for carbonated beverages, and a closure 12. Both the container neck and the closure are formed from plastics material. The container neck is preferably formed by blow moulding of polyethylene terephthalate as is conventionally known for carbonated beverage containers. The closure is preferably formed by injection moulding of polypropylene. The closure 12 comprises a base portion 14 and a skirt portion 16.

Figure 3:
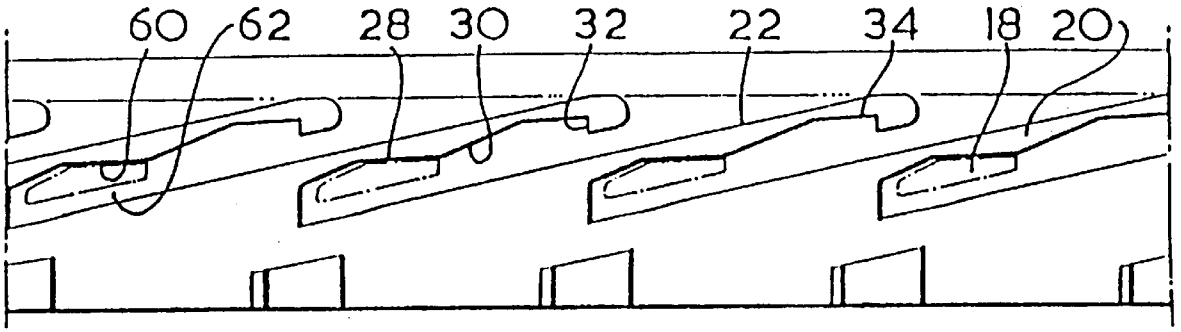
FIG. 3 shows a plane projection of the screw threads of the container neck of FIG. 1, with the screw threads of the closure shown in phantom, and with the closure in the fully engaged position.
Figure 4:
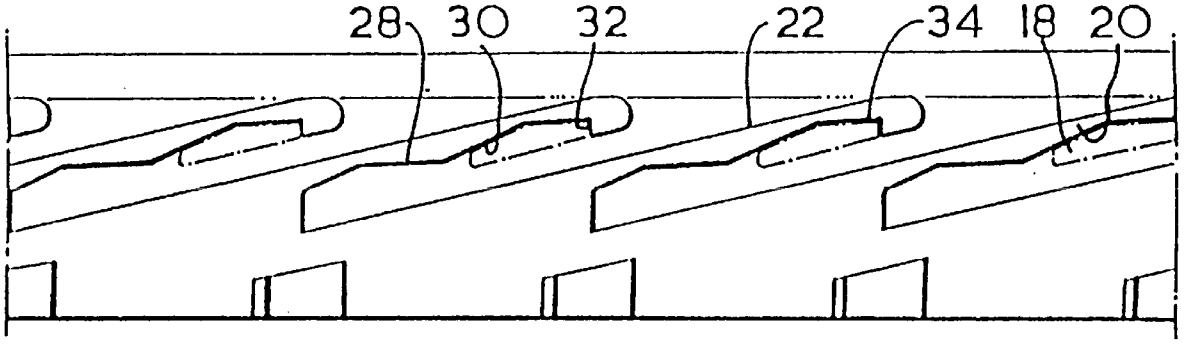
FIG. 4 shows a similar projection to FIG. 3, but with the screw threads of the closure at the intermediate, blocked, gas-venting position.
Figure 5:
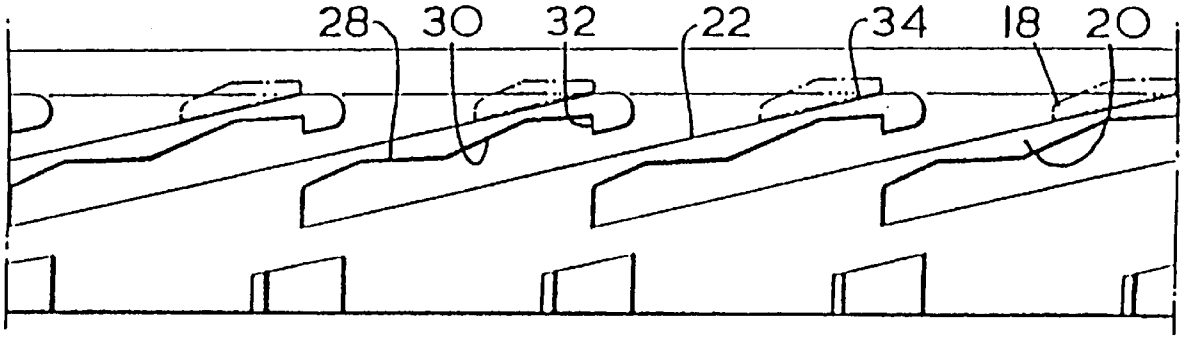
FIG. 5 shows a similar projection to FIGS. 3 and 4, but with the screw threads of the closure in the unblocked screwing/unscrewing position.

On the inside of the skirt portion 16 there is provided a four-start first screw thread made up of four first thread segments 18, as shown in phantom on the thread developments of FIGS. 3–5. The first thread segments 18 are short thread segments having an upper surface 60 with relatively low pitch of about 20 and a lower surface 62 with intermediate pitch of about 13.5°.

The container neck 10 is provided with a second screw thread formed from four second thread segments 20, each of which is a substantially continuous helical thread having an upper thread surface 22 and a lower thread surface 24. A substantially continuous, approximately helical thread path 26 is defined between the said upper and lower surfaces 22, 24.

The main characterising feature of this assembly is the profiling of the lower surface 24 of the second thread segments 20. The lower thread surface 24 comprises a first, lower region 28 having a substantially constant pitch of only about 2°. The lower region 28 adjoins an intermediate region 30 having a substantially constant, much higher pitch of about 18°. The average pitch of the thread segment 20 (i.e. the pitch of the straight upper thread surface 22) is 13.5°.

The second thread segments 20 also include a pressure safety feature similar to that described and claimed in our International Patent Application WO95/05322. Briefly, a step 32 is provided in the lower surface 24 of the second thread segment 20 to abut against an end of the first thread segments 18 and block unscrewing of the closure 12 from the neck 10 when the said first thread segments 18 are in abutment with the lower surface 24, i.e. when there is a net force on the closure in an axial direction out of the container neck. A third region 34 of the lower surface 24 of the second thread segments situated adjacent to the step 32 also has a low pitch of about 2°.

The container and closure assembly is provided with complementary locking means on the container neck and the closure to block unscrewing of the closure from the fully engaged position on the container neck unless a minimum unscrewing torque is applied. These locking elements comprise four equally radially spaced locking ribs 36 on the inside of the closure skirt 16, and four equally radially spaced retaining ramps 38 on the container neck. The ramps 38 comprise a radially sloped outer face 40, a chamfered upper edge 42 and a radially projecting retaining edge 44 against which the rib 36 on the closure abuts when the closure is fully engaged on the container neck. The complementary locking means may be as described in our International Patent Application WO91/18799, the entire content of which is hereby expressly incorporated by reference.

The container and closure assembly also comprises means for forming a gas-tight seal between the closure and the container neck. These means comprise a gas-tight elastomeric sealing wad 46 that is compressed against a circumferential sealing rib 48 extending around the lip of the container neck. The sealing rib 48 is slightly rounded to permit drinking directly from the mouth of the container neck.

The container closure assembly also comprises a tamper-evident safety feature. This consists of a tamper-evident ring 50 that is initially formed integrally with the skirt 16 of the container closure 12 and joined thereto by frangible bridges 52. The tamper-evident ring 50 comprises a plurality of integrally formed, flexible, radially inwardly pointing retaining tabs 54. A circumferential retaining lip 56 is provided on the container neck 10. Ratchet projections 58 are also provided on the container neck below the circumferential retaining lip 56 and radially spaced around the container neck. The structure and operation of the tamper-evident ring feature are as described and claimed in our International Patent Application WO94/11267, the entire contents of which are expressly incorporated herein by reference.

In use, the closure 12 is secured onto the container neck 10 by screwing down in conventional fashion. The closure 12 can be moved from a fully disengaged position to a fully engaged position on the container neck 10 by rotation through about 90°. When the closure is being screwed down, there is normally a net axial force applied by the user on the closure into the container neck, and accordingly the first thread segments 18 abut against and ride along the upper surface 22 of the second thread segments 20 on the container neck. It can thus be seen that the first thread segments follow a substantially continuous, helical path. The first and second threads are free-running, which is to say that there is substantially no frictional torque between the thread segments until the fully engaged position is neared. These features of a 90° closure rotation, substantially continuous thread path and free-running threads all make the closure extremely easy to secure on the container neck, especially for elderly or arthritic persons, or children.

As the closure nears the fully engaged position on the container neck 10, several things happen. First, the tamper-evident ring 50 starts to ride over the retaining lip 56 on the container neck. The retaining tabs 54 on the tamper-evident ring 50 flex radially outwardly to enable the tamper-evident ring to pass over the retaining lip 56 without excessive radial stress on the frangible bridges 52. At the same time, the flexible retaining tabs 54 are riding over the radial ratchet projections 58 on the container neck in similar fashion.

Second, the locking ribs 36 on the closure skirt 16 ride up the outer ramped surface 40 of the retaining ramps 38 on the container neck. The gentle slope of the ramped surfaces 40, together with the resilience of the closure skirt 16, mean that relatively little additional torque is required to cause the locking ribs 36 to ride up the ramped surfaces 40.

Third, the initial abutment between the sealing wad 46 in the container closure base and the sealing rib 48 on the container neck results in a net axial force on the closure in a direction out of the container neck. This pushes the thread segments 18 on the closure skirt out of abutment with the upper surface 22 of the second thread segments 20 and into abutment with the lower thread surfaces 24 of the second thread segments 20. More specifically, it brings the first thread segments 18 into abutment with the lower region 28 of the lower thread surfaces 24. Continued rotation of the closure cap in a screwing-down direction causes the first thread segments 18 to travel along the lower region 28 until the final, fully engaged position shown in FIG. 3 is reached. The low pitch of the lower surface 28 means that this further rotation applies powerful leverage (camming) to compress the sealing wad 46 against the sealing rib 48 in order to achieve an effective gas-tight seal.

When the closure 12 is in the fully engaged position on the container neck 10, the upper surfaces 60 of the first thread segments 16 abut against the lower region 28 of the lower thread surfaces 24 of the second thread segment 20 on the container neck, as shown in FIG. 3. The upper surface of the first thread segments has a low pitch to match that of the lower region 28, so as to maximise the contact area between the thread segments in this region 28, and thereby distribute the axial force exerted by the closure as evenly as possible around the container neck. Because of the low pitch in the region 28, relatively little of the axial force emerging from the container neck due to pressure inside the container is cammed into unscrewing rotational force by the abutment between the thread surfaces in this position. This greatly reduces the tendency of the closure to unscrew spontaneously under pressure. Spontaneous unscrewing is also prevented by the abutment between the locking ribs 36 and the retaining edge 44 on the locking ramps 38. An important advantage of the present invention is that the reduced tendency to unscrew spontaneously due to the low pitch of the lower thread surfaces in the lower regions 28 means that the minimum opening torque of the locking elements 36, 38 can be reduced without risk of the closure blowing off spontaneously. This makes the closure easier to remove by elderly or arthritic people, or by children, without reducing the pressure safety of the closure.

In use, the closure is removed from the container neck by simple unscrewing. An initial, minimum unscrewing torque is required to overcome the resistance of the locking elements 36, 38. Once this resistance has been overcome, essentially no torque needs to be applied by the user to unscrew the closure. The internal pressure inside the container exerts an axial force on the closure in a direction emerging from the mouth of the container, as a result of which the first thread segments 18 ride along the lower surface 28 of the second thread segments 20 as the closure is unscrewed. The first thread segments initially ride along the lower region 28, and then along the steeply pitched intermediate region 30 of the lower surface of the second thread segments 20. The first thread segments 18 then come into abutment with the step 32 of the second thread segments 20, as shown in FIG. 4. In this position, further unscrewing of the closure is blocked while gas venting takes place along the thread paths 26. It should also be noted that, in this intermediate gas venting position, the first thread segments 18 abut primarily against the third region 34 of the lower surface of the second thread segments 20. The low pitch of this region 34 results in relatively little of the axial force on the closure being cammed into unscrewing rotational torque, thereby reducing the tendency of the closure to override the pressure safety feature and blow off.

Once gas venting from inside the container neck is complete so that there is no longer axial upward force on the closure, the closure can drop down so as to bring the thread segments 18 into abutment with the upper surfaces 22 of the second thread segments 20. In this position, unscrewing can be continued to disengage the closure completely from the container neck as shown in FIGS. 5 and 8.

Figure 6:
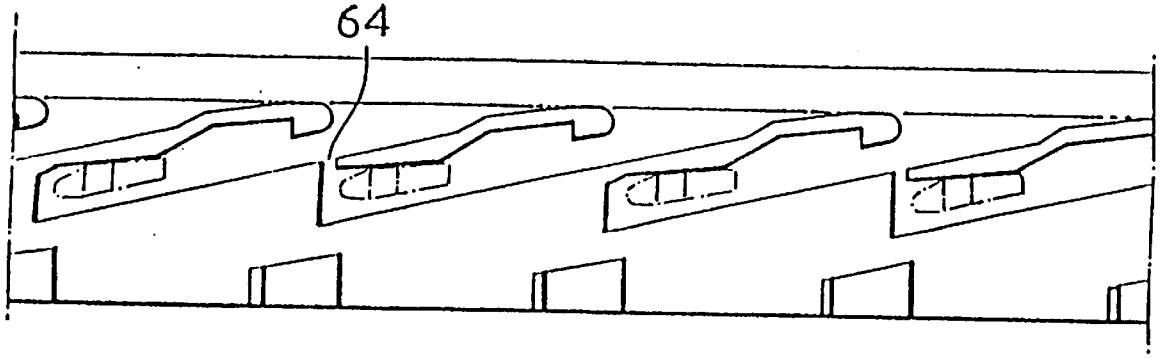
FIGS. 6–8 show plane projections corresponding to FIGS. 3–5 for screw threads according to an alternative embodiment of the present invention.
Figure 7:
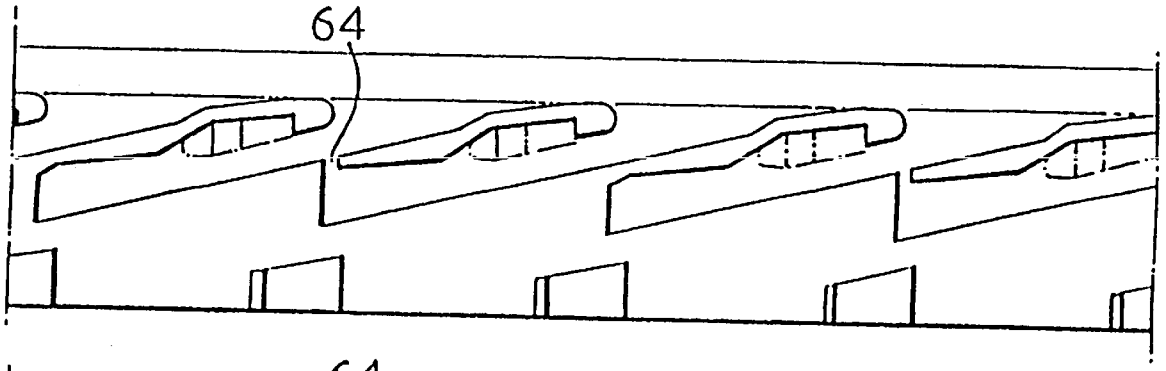
Figure 8:
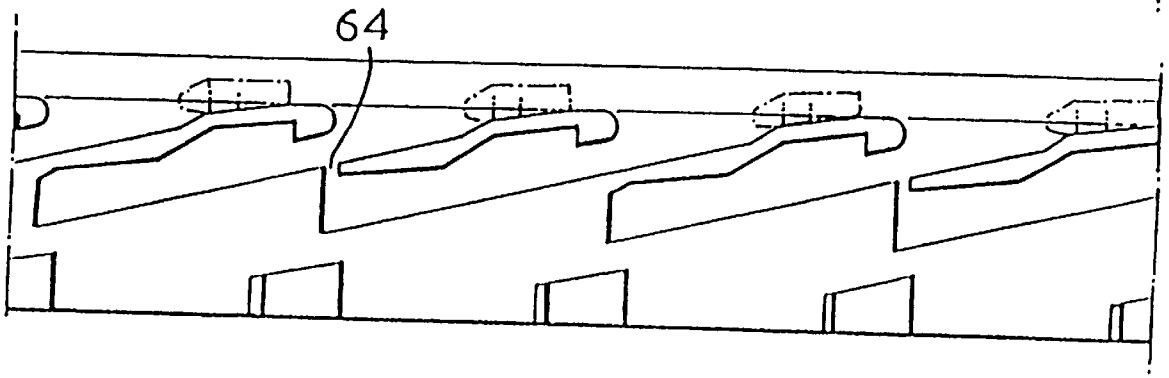

Referring to FIGS. 6 8, the alternative embodiment shown therein has improved thread profiling. In addition, transverse axial gas vents 64 are provided across two of the second thread segments to increase the rate of gas venting when the closure is at the intermediate, gas-venting position shown in FIG. 7.

Figure 10:
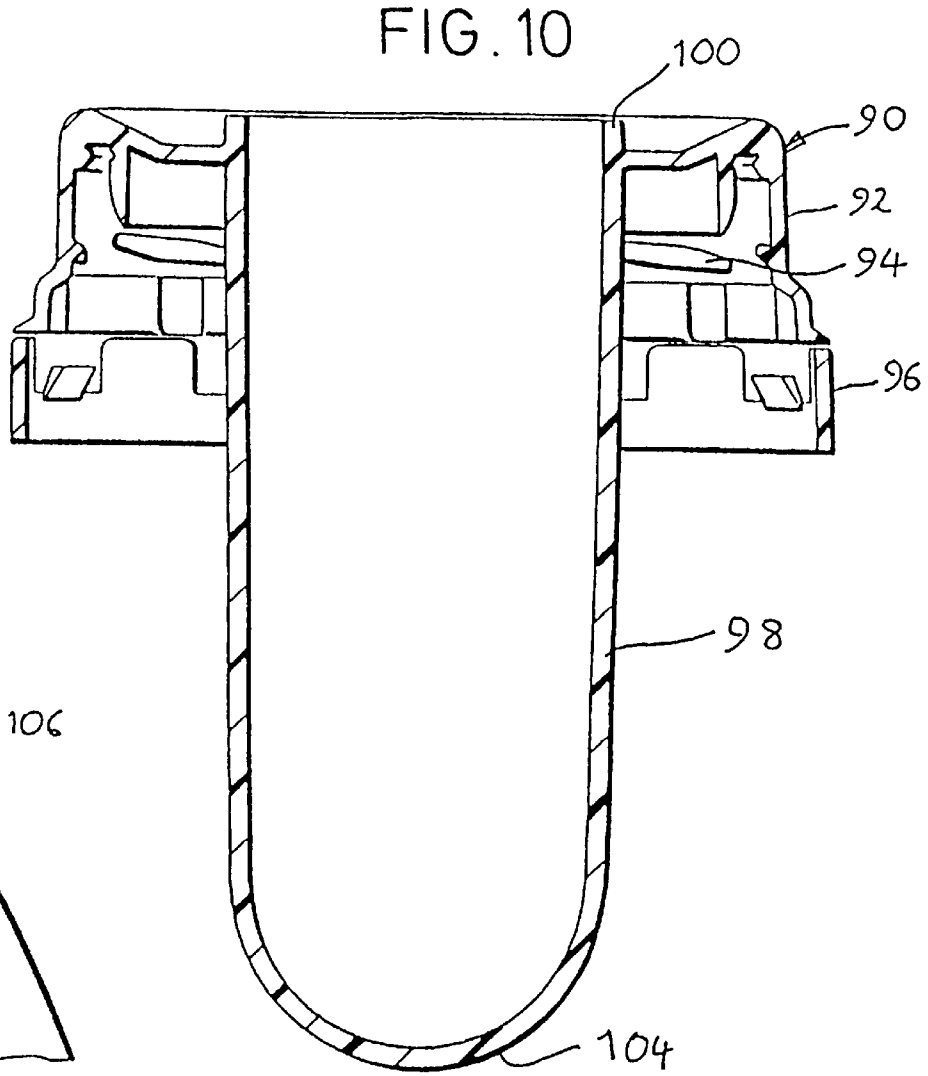
FIG. 10 shows a longitudinal sectional view of a container closure assembly comprising the closure of FIG. 9 fully secured on a container neck.
Figure 9:
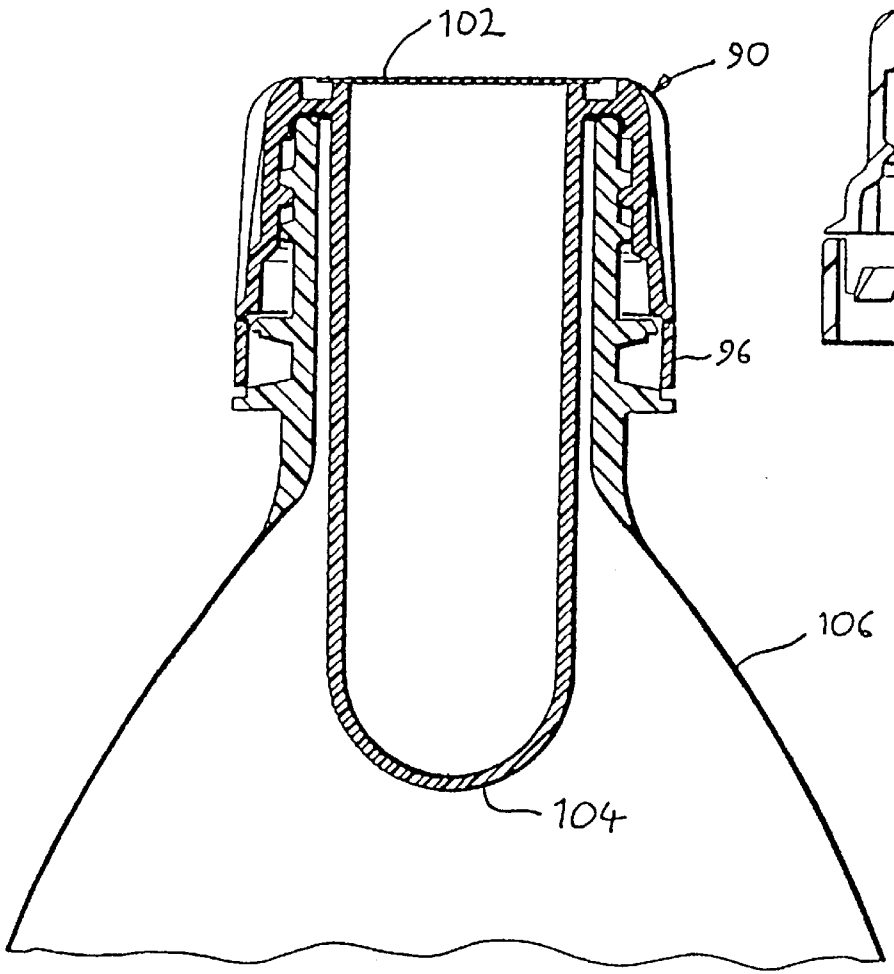
FIG. 9 shows a longitudinal section view of a closure for use in a further embodiment of the present invention, having a storage cell formed integrally therewith.

Referring to FIGS. 9 and 10, the closure 90 in this embodiment of the invention comprises a skirt portion 92, thread segments 94 and a tamper-evident ring 96 substantially as hereinbefore described for FIGS. 1–5. The closure 90 also comprises a storage cell 98.

The storage cell 98 is in the form of an open-ended cylinder. The open end of the cylinder is located in the crown portion of the closure 90, where it defines a circular mouth 100 for the storage cell. A plastics-laminated foil sealing web 102 is heat bonded across the mouth of the storage cell 98. The opposite end of the storage cell 98 is a continuous, rounded, closed end 104.

The closure crown, skirt, tamper-evident ring and storage cell are all formed integrally in one piece by injection moulding of polypropylene.

In use, the storage cell 98 is preferably used to store a colouring or flavouring ingredient, preferably a solid colouring or flavouring ingredient, for a carbonated beverage (e.g. soda water) in the main container 106. The colouring or flavouring ingredient from the storage capsule can be dispensed either before or after dispensing of the liquid from main container by simply removing the peel-off sealing web 102 from the mouth 100 of the storage cell 98 and pouring. A particular advantage of this assembly is that the storage cell presents a smooth, continuous and completely gas- and liquid-tight surface to the interior of container 106. This means that there is no risk of gas or liquid from inside container 106 leaking into storage cell 98, even when the contents of container 106 are pressurized, e.g. a carbonated beverage.

The above embodiments have been described by way of example only. Many other embodiments of the present invention falling within the scope of the accompanying claims will be apparent to the skilled reader.

We claim:

1. A container closure assembly comprising:

a container neck having an opening;

a closure for said neck, the closure having a crown portion and a skirt portion;

a first screw thread on one of said neck and said closure, said first screw thread comprising one or more elongate first thread segments, each first thread segment having upper and lower first thread surfaces; and a substantially continuous second screw thread on the other of said neck and said closure, said second screw thread comprising one ore more elongate second thread segments, each second thread segment having upper and lower second thread surfaces, wherein the pitch of the lower second thread surface is relatively lower in a first region, relatively higher in a second region displaced from the first region in an unscrewing direction and relatively lower in a third region displaced from said second region in a unscrewing direction, and wherein said lower second thread surface further comprises a step adjacent to said third region to provide a first abutment surface against which a second abutment surface on one of said first screw segments abuts to block or restrict rotation of said closure in an unscrewing direction at an intermediate position when said closure is under axial pressure in a direction emerging from the container neck, said neck and closure being constructed and arranged to provide a vent for venting gas from said container neck at least when said closure is in said intermediate position, and said neck and closure being constructed and arranged to enable said step and said first screw segments to be moved out of engagement by axial displacement of the closure inwardly on said neck at said intermediate position, and wherein the lower second thread surface in said first region forms a matching fit with a major part of said upper first thread surface when the closure is fully secured in the container neck, and said third region forms a matching fit with a major part of said third region of said upper first thread surface when the closure is at said intermediate position and outwardly displaced on said container neck.

2. A container closure assembly according to claim 1, wherein the pitch of the lower second thread surface in the first region is substantially constant.

3. A container closure assembly according to claim 1 or 2, wherein the first region extends for 20–40° about the circumference of the container neck of the closure skirt.

4. A container closure assembly according to claim 1 or 2, wherein the pitch of the lower second thread surface in the first region is in the range −5° to 10°.

5. A container closure assembly according to claim 4, wherein the pitch of the lower second thread surface in the first region is in the range 1° to 7°.

6. A container closure assembly according to claim 1, wherein the second region is adjacent to the first region of the lower second thread surface.

7. A container closure assembly according to claim 1, wherein the pitch of the lower second thread surface in the second region is substantially constant and the second region extend for 15–35° about the circumference of the container neck or the closure skirt.

8. A container closure assembly according to claim 1, wherein the pitch of the lower second thread surface in the second region is in the range 8° to 20°.

9. A container closure assembly according to claim 1, further comprising means to form a seal between all container neck and the closure when the closure is fully engaged on the container neck.

10. A container closure assembly according to claim 9, wherein the means to form a seal comprises a compressible sealing wad inside the base portion of the closure for abutting against a lip of the container neck.

11. A container closure assembly according to claim 1, wherein the assembly further comprises complementary locking means on the container neck and the closure that prevent unscrewing of the closure from the fully engaged position of the container neck until a predetermined minimum opening torque is applied.

12. A container closure assembly according to claim 11, wherein the locking means comprise a longitudinal locking rib on one of the container neck or on the skirt portion of the closure, and a complementary locking ramp on the other of the container neck or the skirt portion of the closure, said locking rib abutting against a retaining edge of the locking ramp when the closure is fully engaged on the container neck.

13. A container closure assembly according to claim 1, further comprising a tamper-evident ring attached to the skirt portion of the closure.

14. A container closure assembly according to claim 1, wherein at least one of said first and second threads has at least two thread starts.

15. A assembly according to claim 14, wherein at least one of said first and second threads has four thread starts.

16. A container closure assembly according to claim 1, wherein the closure can be moved from a fully released to a fully engaged position on the neck by a single smooth rotation through 360° or less.

17. A container closure assembly according to claim 16, wherein the closure can be moved from a fully released to a fully closed position on the neck by a single smooth rotation through 180° or less.

18. A container closure assembly according to claim 17, wherein the closure can be moved from a fully released to a fully closed position on the neck by a single smooth rotation through about 90° or less.

19. A container closure assembly according to claim 1, wherein said closure further comprises:

a storage cell having a mouth in the crown portion of the cap and a continuous, sealed body portion formed in one piece integrally with the crown portion of the cap and extending downwardly from the said crown portion inside the neck of the container; and a removable sealing means to seal the mouth of the storage cell.

20. A container closure assembly according to claim 19, wherein the body of the storage cell is substantially cylindrical.

21. A container closure assembly according to claim 19 or 20 wherein the mouth of the storage cell is a substantially circular aperture in the crown portion of the closure.

22. A container closure assembly according to claim 19 or 20, wherein the removable sealing means comprises a peel-off sealing web.

* * * * *

UNITED STATES PATENT AND TRADEMARK OFFICE

CERTIFICATE OF CORRECTION

PATENT NO. : 6,015,054
DATED : January 18, 2000
INVENTOR(S) : Roger Milner King et al.

It is certified that error appears in the above-identified patent and that said Letters Patent is hereby corrected as shown below:

Claim 1,
Line 11, change "ore" to -- or --.
Line 18, change "in a unscrewing" to -- in an unscrewing --.

Claim 7,
Line 4, change "extend" to -- extends --.

Claim 9,
Line 2, change "all" to -- the --.

Claim 11,
Line 5, change "of the" to -- on the --.

Claim 15,
Line 1, change "A assembly" to -- An assembly --.

Signed and Sealed this

Eighteenth Day of December, 2001

*Attest:*

*Attesting Officer*

JAMES E. ROGAN
*Director of the United States Patent and Trademark Office*